US006716000B2

(12) United States Patent
Appleton et al.

(10) Patent No.: US 6,716,000 B2
(45) Date of Patent: Apr. 6, 2004

(54) FUEL PUMP DELIVERY UNIT

(75) Inventors: John Appleton, West Mids (GB); Simon Browning, London (GB)

(73) Assignee: Siemens AG, Munich (DE)

( * ) Notice: Subject to any disclaimer, the term of this patent is extended or adjusted under 35 U.S.C. 154(b) by 0 days.

(21) Appl. No.: 09/937,933

(22) PCT Filed: Feb. 2, 2001

(86) PCT No.: PCT/EP01/01107

§ 371 (c)(1),
(2), (4) Date: Mar. 20, 2002

(87) PCT Pub. No.: WO01/57386

PCT Pub. Date: Aug. 9, 2001

(65) Prior Publication Data

US 2002/0119056 A1 Aug. 29, 2002

(30) Foreign Application Priority Data

Feb. 2, 2000 (DE) ..... 100 04 356

(51) Int. Cl.[7] ..... F04B 17/03

(52) U.S. Cl. ..... 417/360; 417/423.3; 417/423.15; 137/565.01; 137/509

(58) Field of Search ..... 417/360, 423.3, 417/423.15; 137/565.01; 123/509

(56) References Cited

U.S. PATENT DOCUMENTS

| | | | | | |
|---|---|---|---|---|---|
| 4,869,225 | A | * | 9/1989 | Nagata et al. | 123/509 |
| 5,522,425 | A | * | 6/1996 | Kroiss et al. | 137/590 |
| 6,000,913 | A | * | 12/1999 | Chung et al. | 417/53 |
| 6,230,690 | B1 | * | 5/2001 | Umetsu | 123/509 |
| 6,308,733 | B2 | * | 10/2001 | Murakoshi et al. | 137/565.34 |
| 2001/0001963 | A1 | * | 5/2001 | Murakoshi et al. | 137/565.34 |

FOREIGN PATENT DOCUMENTS

| | | | |
|---|---|---|---|
| DE | 199 12 494 A1 | 9/1999 | F02M/38/10 |
| EP | 0 941 885 A2 | 9/1999 | B60K/15/077 |

* cited by examiner

*Primary Examiner*—Justine R. Yu
*Assistant Examiner*—Emmanuel Sayoc
(74) *Attorney, Agent, or Firm*—Richard A. Speer

(57) ABSTRACT

A fuel delivery unit (2) for delivering fuel from a tank (1) in which a support (6) connects a flange (4) to a surge chamber (5) through a pivot bearing (12). The pivot bearing (12) makes it possible to introduce the delivery unit (2) in an elongated state into the fuel tank (1) through a particularly small opening. Within the fuel tank (1) the surge chamber (5) is locked in its designated position.

7 Claims, 1 Drawing Sheet

FUEL PUMP DELIVERY UNIT

BACKGROUND OF THE INVENTION

The invention relates to a delivery unit having a delivery pump for delivering fuel from a fuel tank to an internal combustion engine of a motor vehicle, having a flange which is to be fixed in an opening of the fuel tank and having a support for securing the delivery pump and/or a surge chamber in a designated position in the fuel tank.

Delivery units of this type are frequently used in motor vehicles today and are known in practice. The support of the known delivery unit is of telescopic design and has a spring for prestressing a constructional unit comprising the delivery pump and surge chamber toward the bottom of the fuel tank. The flange closes the opening in the fuel tank.

A disadvantage of the known delivery unit is that in the case of today's generally very flat fuel tanks the delivery pump and the surge chamber are of very wide design and therefore requires a very wide opening. However, a large opening in the fuel tank inevitably leads to a large sealing region between the flange and the fuel tank and therefore to a large escape of fuel vapors from the fuel tank.

The invention is based on the problem of designing a delivery unit of the type mentioned at the beginning in such a manner that it requires a particularly small opening in the fuel tank and can be fitted in as simple a manner as possible.

BRIEF SUMMARY OF THE INVENTION

According to the invention, this problem is solved by at least one pivotable means of securing the surge chamber and/or the delivery pump with respect to the flange when the delivery unit is separated from the fuel tank.

This design enables the delivery pump or the surge chamber to be pivoted into a space-saving position and introduced into the fuel tank. The surge chamber, which is of a low size, can also be of elongated design. The delivery unit according to the invention can thereby be fitted through particularly small openings and in very flat fuel tanks. The support holds the delivery unit and/or the surge chamber in the designated position when fitted into the fuel tank. The delivery unit according to the invention can therefore be fitted in a particularly simple manner.

The support could have, for example, a flexible shaft or a spring element for the pivotable means of securing the delivery pump or the surge chamber. The delivery unit according to the invention is designed in a particularly simple manner structurally and has great stability if the support has a pivot bearing. The pivot bearing can either have a bearing spindle for pivoting the delivery pump or the surge chamber in one direction or a spherical head for pivotability in two directions.

According to another advantageous development of the invention, the means of securing the delivery pump and/or the surge chamber in the designated position in the fuel tank requires a particularly low constructional outlay if the pivot bearing has means for locking it in a designated position.

The surge chamber or the delivery pump is frequently not arranged precisely below the opening of the fuel tank. According to another advantageous development of the invention, a bending moment acting on the flange can be reliably avoided if the support is designed to prestress the pivot bearing in the direction of the bottom of the fuel tank. This design leads to a particularly low stress on the connection of the flange to the fuel tank. This further reduces an escape of fuel vapors out of the fuel tank.

Tilting of the surge chamber or the delivery unit within the fuel tank can be avoided in a simple manner if on its region lying opposite the pivot bearing the support has a supporting arm which is provided for supporting it on the bottom of the fuel tank. By means of this design, it can also be ensured that only perpendicular forces are introduced into the flange.

The delivery unit according to the invention is reliably held in its designated position if the support engages laterally around the surge chamber or the delivery pump.

The bottom of the fuel tank frequently has tolerances which, in the case of the known delivery unit, lead to an uneven arrangement of the delivery unit or the surge chamber. However, according to another advantageous development of the invention, the delivery unit and/or the surge chamber bear in a particularly smooth manner against the bottom of the fuel tank if a connection of the support to the surge chamber or to the delivery unit has a mounting means.

The structural simplification of the delivery unit according to the invention is assisted further if the support has a first supporting part which is fixed vertically to the flange and a second supporting part having the supporting arm, and if the pivot bearing is arranged between the two supporting parts.

After installation in the fuel tank the delivery unit according to the invention is held in its designated position in a particularly reliable manner if the first supporting part has a guide for a locking part penetrating into a recess of the second supporting part.

According to another advantageous development of the invention, the means for locking the supporting parts in their designated position are designed in a particularly simple manner structurally if the guide of the first supporting part and the recess of the second supporting part are each designed as holes in alignment with each other and the locking part is designed as a rod.

In a further advantageous refinement, the surge chamber is effectively prevented from twisting with respect to the flange by two supports being arranged instead of one support. The arrangement of the supports on both sides of the surge chamber has proven advantageous. Otherwise, these supports have the same designs as the device according to the invention having one support.

BRIEF DESCRIPTION OF THE DRAWINGS

The invention permits numerous embodiments. To further clarify its basic principle one of these is illustrated in the drawing and is described below. In the drawing.

DETAILED DESCRIPTION OF THE PREFERRED EMBODIMENT

Figure 1:
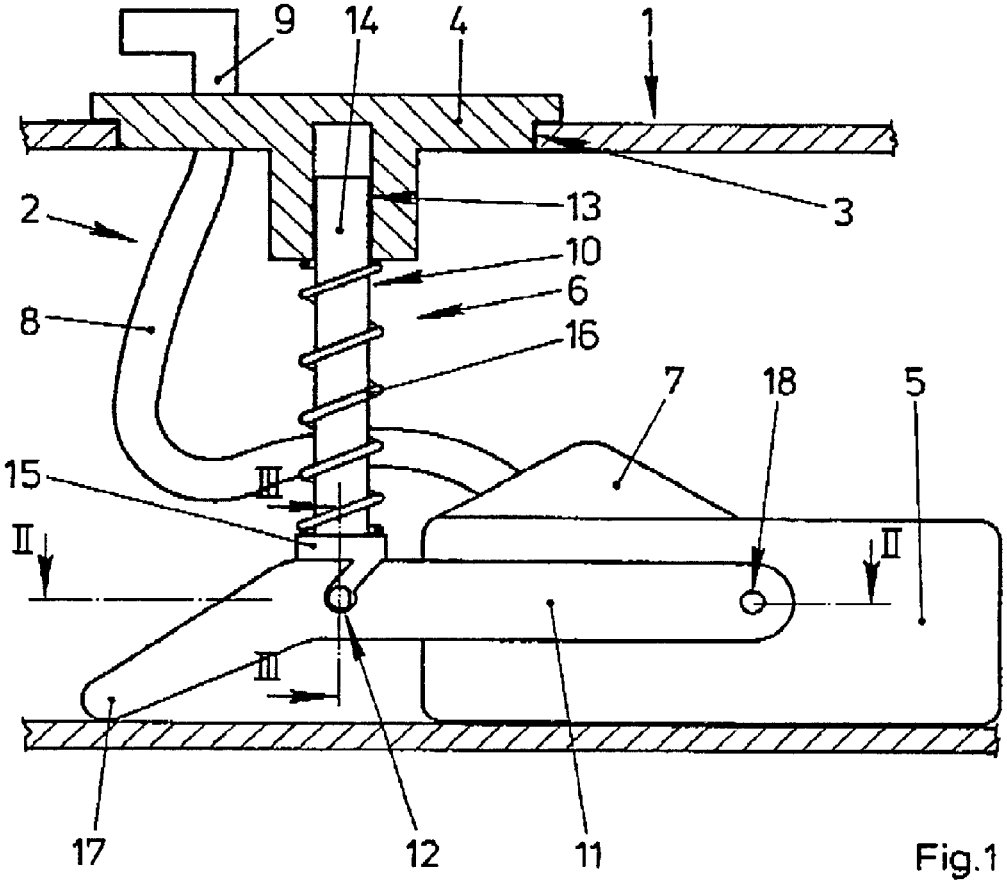
FIG. 1 shows, schematically, a delivery unit according to the invention fitted in a fuel tank.

FIG. 1 shows a fuel tank 1 of a motor vehicle having a delivery unit 2 arranged in it. The delivery unit 2 has a flange 4 which is inserted in an opening 3 of the fuel tank 1, and a surge chamber 5. The flange 4 and the surge chamber 5 are connected to each other via a support 6. Arranged within the surge chamber 5 is a delivery pump 7. The delivery pump 7 delivers fuel from the surge chamber 5 via a flexible line 8 to a connecting branch 9 arranged on the outside of the flange 4. A forward-flow line leading to an internal combustion engine (not illustrated) can be connected to the connecting branch 9. The support 6 has a first supporting part 10 which is fixed on the flange 4 and a second supporting part 11 connected to the surge chamber 5. The two supporting parts 10, 11 are connected to each other via a pivot bearing 12. The flange 4 has an axial guide 13 for a rod 14 of the first supporting part 10. A bearing bracket 15 of the pivot bearing 12 is prestressed by a spring 16, which is supported on the flange 4, in the direction of the bottom of the fuel tank 1. On its side facing away from the surge chamber 5, the second supporting part 11 has a supporting arm 17 with which it is supported on the bottom of the fuel tank 1. The connection of the second supporting part 11 to the surge chamber 5 has a mounting means 18. By this means, the surge chamber 5 is reliably prestressed toward the bottom of the fuel tank 1. The pivot bearing 12 prevents the introduction of a bending moment into the firsts supporting part 10 and therefore into the flange 4.

Before the delivery unit 2 is installed in the fuel tank 1 the pivot bearing 12 enables the two supporting parts 10, 11 to be brought into an elongated position with respect to each other. By this means, the surge chamber 5 can be introduced particularly easily into the fuel tank 1 through the opening 3.

Figure 2:
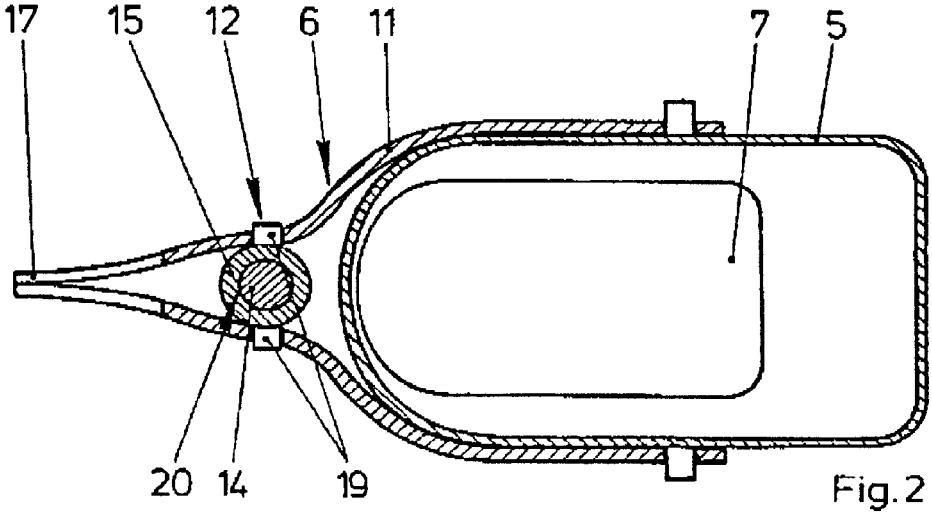
FIG. 2 shows a sectional illustration through the delivery unit from FIG. 1 along the line 11—11.

FIG. 2 shows, in a sectional illustration through the support 6 from FIG. 1 along the line 11—11 in the region of the pivot bearing 12 and of the surge chamber 5, that the second supporting part 11 engages laterally around the surge chamber 5. The pivot bearing 12 has bearing pins 19 arranged on the bearing bracket 15. The rod 14, which is guided axially in the flange 4 illustrated in FIG. 1, penetrates the bearing bracket 15. The bearing bracket 15 has a hole 20 for receiving the rod 14.

What is claimed is:

1. A delivery unit having a delivery pump for delivering fuel from a fuel tank to an internal combustion engine of a motor vehicle, comprising: a flange which is to be fixed in an opening of the fuel tank;

an elongated member formed integrally with the flange to extend into the tank, which elongated member has an elongated opening that defines an axial guide;

a first supporting part having one end slidably located within the axial guide of the elongated member and having a second end located within the tank a preselected distance from the flange; a second supporting part having (i) a first supporting arm that has the delivery pump and/or surge chamber mounted thereon for contact with the bottom of the tank and having (ii) a second supporting arm for contact with the bottom of the fuel tank; and a pivot bearing with a bracket slidably mounted on the first supporting part in the area of the second end thereof, the bearing bracket being rotatably connected to the second supporting part intermediate the first and second arms thereof.

2. The delivery unit as claimed in claim 1, characterized in that the pivot bearing has means for locking it in a designated position.

3. The delivery unit as defined in claim 1 characterized in that the support is designed to prestress the pivot bearing in the direction of the bottom of the fuel tank.

4. The delivery unit as defined in claim 1 characterized in that the support has an arm which extends outwardly and downwardly from the pivot bearing into contact with the bottom of the fuel tank.

5. The delivery unit as defined in claim 1 characterized in that the support (6) has a first supporting part (10) which is fixed vertically to the flange (4) and a second supporting part (11) having the supporting arm (17), and in that the pivot bearing (12) is arranged between the two supporting parts (10, 11).

6. The delivery unit as defined in claim 5, characterized in that the first supporting part (10) has a guide for a locking part penetrating into a recess of the second supporting part (11).

7. The delivery unit as defined in claim 5 or 6 characterized in that the guide of the first supporting part (10) and the recess of the second supporting part (11) are each designed as holes (20) in alignment with each other and the locking part is designed as a rod (14).

* * * * *